United States Patent [19]

Svirklys

[11] 4,145,976

[45] Mar. 27, 1979

[54] PALLET CONSTRUCTION

[75] Inventor: Ferdinand M. Svirklys, Toronto, Canada

[73] Assignee: Extrados Company Limited, Toronto, Canada

[21] Appl. No.: 890,129

[22] Filed: Mar. 27, 1978

[30] Foreign Application Priority Data

Mar. 31, 1977 [GB] United Kingdom ..... 13714/77

[51] Int. Cl.[2] ..... B65D 19/28

[52] U.S. Cl. ..... 108/56.1; 403/231; 403/353

[58] Field of Search ..... 108/51.1, 53.1, 53.5, 108/55.1, 55.3, 56.1, 56.3, 57.1; 52/473; 403/231, 353, 308

[56] References Cited

U.S. PATENT DOCUMENTS

| | | | |
|---|---|---|---|
| 3,349,538 | 10/1967 | Crossman | 52/301 X |
| 3,971,326 | 7/1976 | Svirklys | 108/56.1 |
| 4,066,370 | 1/1978 | Van Driessche | 403/231 X |
| 4,077,334 | 3/1978 | Svirklys | 108/56.1 |

*Primary Examiner*—Roy D. Frazier
*Assistant Examiner*—William E. Lyddane
*Attorney, Agent, or Firm*—Sim & McBurney

[57] ABSTRACT

A pallet of the knock-down type constructed of a plurality of releasably interlocking parts comprising spaced stringer elements of rectangular cross-section and a plurality of spaced parallel deck-forming members is improved with respect to strength and other factors by providing end caps in each end of each stringer element which act as part of the fastening arrangement of the end deck-forming member.

21 Claims, 9 Drawing Figures

PALLET CONSTRUCTION

FIELD OF INVENTION

The present invention is directed to pallet constructions.

BACKGROUND TO THE INVENTION

In my prior U.S. Pat. Nos. 3,971,326 and 4,077,334 there are described various readily assemblable and disassemblable pallet structures comprising spaced parallel stringer elements and spaced parallel deck elements arranged transverse to the stringer elements and releasably connected thereto through a unique interconnection. The elements of the pallets preferably are formed of aluminum, generally aluminum extrusions, although other suitable materials of construction may be used, such as, steel or substantially rigid plastic materials.

The pallet constructions of my prior patents utilize stringers of generally rectangular cross-section having open ends and each of deck-forming members, including those adjacent the extremities of the pallet, is releasably attached to each of the stringers through specially designed elongate laterally-thin clips. While this structure is satisfactory and useful in many applications, possible difficulties may arise from the possibility of an errant fork-lift or pallet truck tine striking and dislodging the end deck member at one extremity of the pallet by breaking the clips, as a result of their limited strength. Such dislodgement would require replacement not only of the damaged deck-forming member, but also of the stringer or stringers from which the clips have been broken. Additionally, the open ends of the stringer elements permit the entry of dirt, vermin or other unwanted items into the stringer elements.

SUMMARY OF INVENTION

The present invention is directed to a pallet structure which overcomes the aforementioned prior art problems by increasing substantially the strength of the connection of the end deck-forming members to the stringer elements and by closing off the end openings of the stringer elements. These substantial benefits and improvements are attained by the use of end caps which fit into each end of each stringer element and which are constructed to act as the clip for the outboard edge of the end deck-forming members.

DESCRIPTION OF PREFERRED EMBODIMENTS

Figure 7:
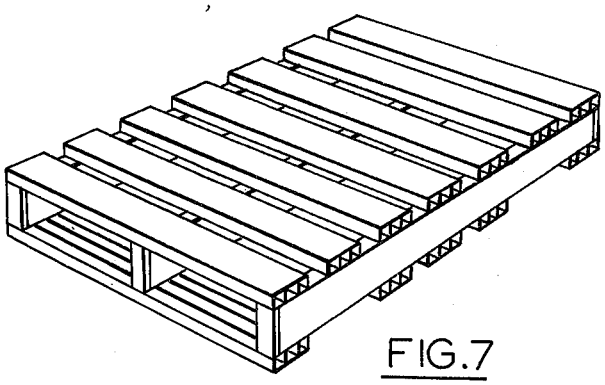
FIG. 7 is a perspective view of a semi-double deck two-way pallet provided in accordance with a fourth embodiment of this invention.

Referring to the drawings, FIGS. 1, 4, 5 and 7 illustrate respectively four of the conventional styles of pallet, namely, single-deck, two way (FIG. 1), double-deck, two-way (FIG. 4), double-deck, four-way (FIG. 5) and semi-double-deck, two-way (FIG. 7). The other conventional pallet style, namely, single-deck, four-way is not illustrated, but it will be obvious to those skilled in the pallet art that this style is a modification of the FIG. 1 structure using the form of stringer shown in FIG. 5.

Figure 1:
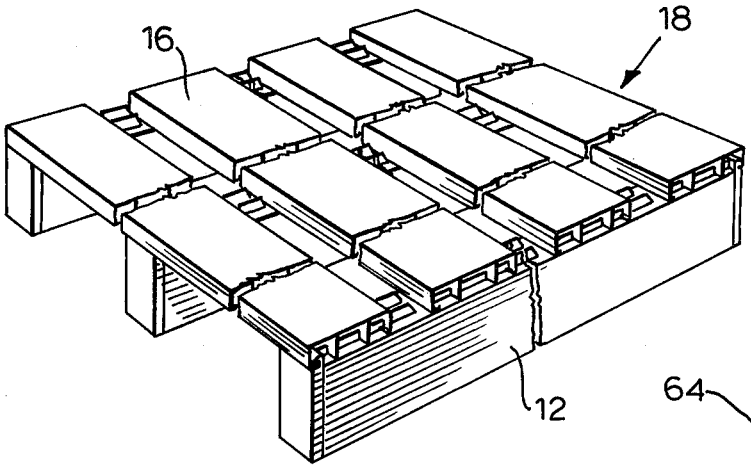
FIG. 1 is a perspective view of a single-deck two-way pallet provided in accordance with one embodiment of the invention.
Figure 2A:
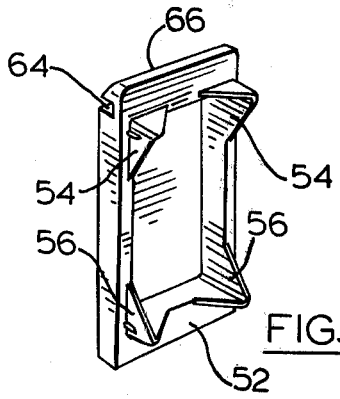
FIG. 2*a* is a perspective view of the end cap used in the structure of FIGS. 1 to 3.
Figure 2:
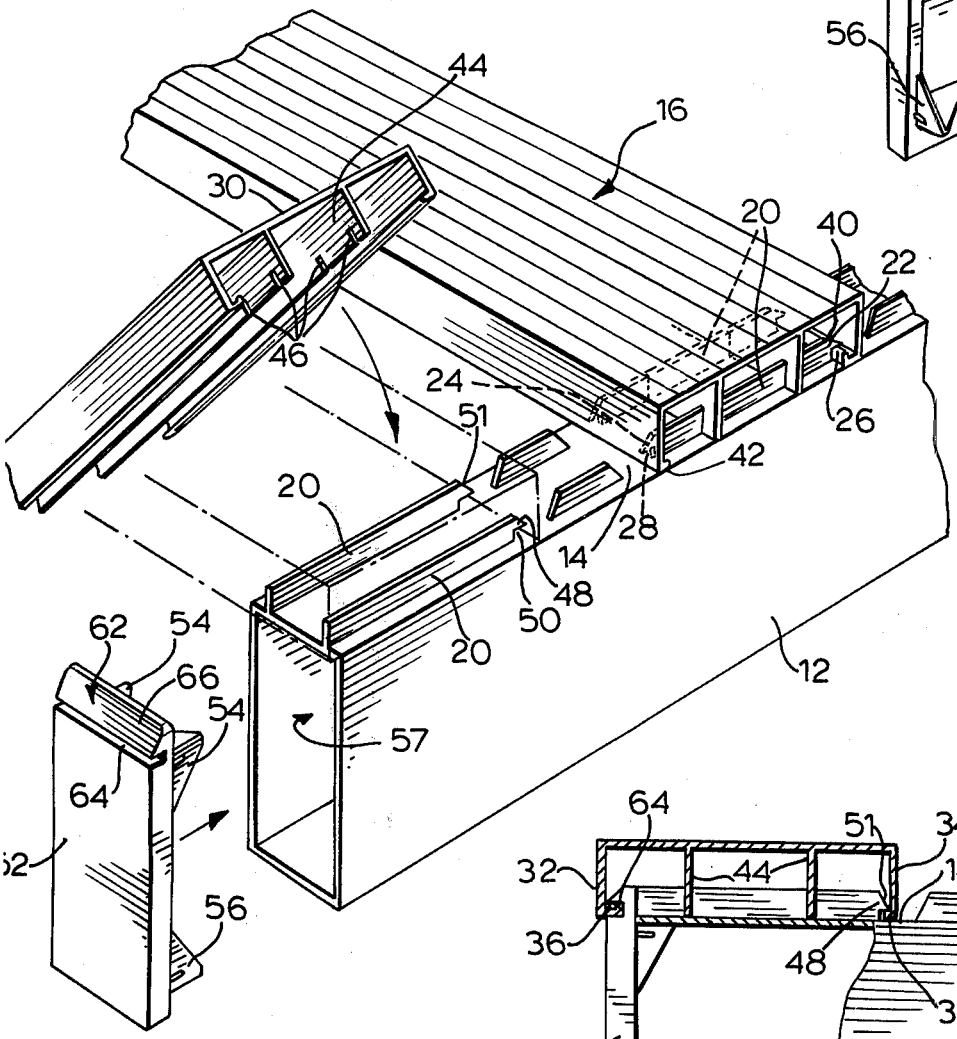
FIG. 2 is a close-up perspective partly-exploded view of the pallet of FIG. 1 illustrating the structure and assembly of the pallet.
Figure 3:
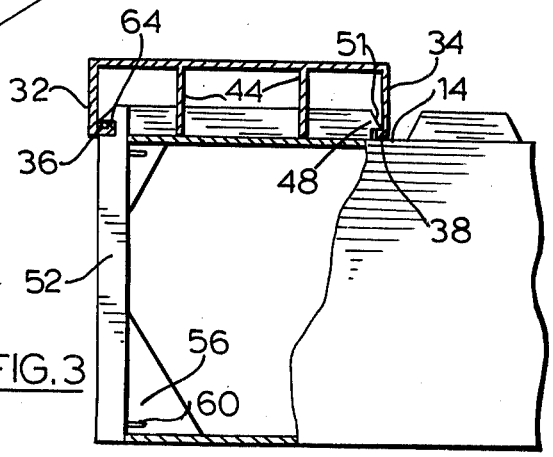
FIG. 3 is a close-up side elevational view, partly in section, of part of the pallet of FIG. 1.

Referring first to FIGS. 1 to 3 of the drawings, a pallet 10 includes three parallel hollow elongate members or stringer elements 12 of rectangular cross-section and arranged with their longer dimension upright so that the upper outer surface 14 of the shorter dimension provide a supporting surface. The number of such stringer elements 12 may be varied depending on the size and strength of the pallet desired.

A plurality of deck-forming elongate extrusions or member 16 is supported on the upper outer surface 14 and is releasably connected to the rectangularly cross-sectioned members 12 in spaced parallel relation generally perpendicular to the members 12 and cooperate to provide a deck 18 on the upper side of the pallet 10.

Each rectangularly cross-sectioned member 12 includes a plurality of pairs of integral parallel elongate laterally-thin protrusions 20 extending from the upper outer surface 14, each protrusion having a longitudinal dimension substantially equal to the width of each deck-forming member 16, with the exception of those at each longitudinal extremity of the member 12.

The number of pairs of protrusions 20 is equal to the number of deck-forming members 16 to be attached to the rectangularly cross-sectioned member 12 and the number is the same for each of the rectangularly cross-sectioned members 12.

The longitudinal spacing apart of the pairs of protrusions 20 from each other on the surface 14 of the rectangularly cross-sectioned member 12 may vary widely, depending on the spacing desired between the deck-forming members 16 in the pallet 10, which in turn is dependent on the desired end use and desired strength of the pallet 10.

Each member of the pairs of protrusions 20 is positioned inwardly spaced from and parallel to the adjacent longitudinal edge of the surface 14, to enable the deck-forming members 16 to terminate flush with the outer edges of the stringers 12, as illustrated. However, each such protrusion member may be positioned at the longitudinal edge, in which event the deck-forming members 16 will extend beyond the lateral extremity of the stringers 12.

Except for the pairs of protrusions 20 at the longitudinal ends of each stringer element 12, the longitudinal ends of each protrusion 20 are undercut to define shoulders 22 and 24 respectively and undercuts 26 and 28 respectively.

Each of the deck-forming members 16 has a continuous planar surface 30 which cooperates with other like surfaces to provide the deck surface 18. Depending generally perpendicularly from each lateral extremity of the planar surface 30 are integral skirt portions 32 and 34 and at the lower end of each skirt portion 32 and 34 is a shoulder-engaging member 36 and 38 respectively. The skirt portions 32 and 34 may be positioned inwardly from the lateral extremities of the planar surface 30, if desired.

As seen in FIGS. 2 and 3, at least the deck-forming members 16 at the sides of the pallet 10 are provided with the skirt member 32 thicker than the skirt member 34 to provide additional strength at the pallet extremities. Such thicker skirt member 32 also imparts additional strength to the pallet useful during assembly and disassembly.

Each of the shoulder-engaging members 36 and 38 includes a portion projecting inwardly of the skirt 32 or 34 and a shoulder face-engaging portion. Generally, shoulder-engaging member 36 projects inwardly a greater distance than shoulder-engaging member 38 and a distance substantially equal to the depth of the undercut 26.

While the undercuts 26 and 28 have the same dimensions and depth, which is approximately equal to the extremity of the shoulder-engaging member 36, this arrangement is for convenience in assembly of the pallet 10, allowing the longer shoulder-engaging member 36 to be inserted in either undercut to engage both the shoulder and the end wall of the undercut. If desired, however, each of the undercuts 26 and 28 may be dimensioned to correspond to the dimensions of the respective shoulder-engaging memberd 36 and 38 to be received therein.

Each shoulder 22 and 24 has a sloping outer surface 40 and the surface 42 of the shoulder-engaging member 38 intended to engage the sloping surface 40 during assembly.

Each of the deck-forming members 16 also comprises a pair of webs or spacer elements 44 integral with and depending from the planar surface 30 and arranged parallel to the skirt portions 32 and 34.

Slots 46 are provided in each of the webs 44 for receiving the protrusions 20 therein when the pallet is assembled to prevent longitudinal displacement of the deck-forming members 16 relative to the stringer elements 12 in an assembled pallet.

Each of the deck-forming members 14 has a thickness and size allowing limited flexibility when bent about its longitudinal centre line to permit assembly and disassembly of the pallet 10 without special tools or skills.

At the longitudinal ends of each stringer element 12, the protrusions 20 are provided, at the end remote from the stringer end only, with a shoulder 48, an undercut 50 and a sloping surface 51 corresponding to the shoulder 24, undercut 28 and sloping surface 40 respectively of the other protrusions 20, and terminate flush with the stringer end at the other end thereof.

The stringer elements 12 and the deck-forming members 16 generally are formed of the same material of construction, although dissimilar materials may be used. In one preferred aspect of the invention, the material of construction is aluminum and the stringer elements 12 and the deck-forming members 16 preferably are formed by extrusion, with the protrusions 20 being formed by cutting or stamping away relevant portions of continuous extruded strips.

An end cap 52 is fitted into each end of each stringer element 12. The end caps 52 may be formed of any convenient material of construction, for example, aluminum, steel, or rigid plastic, and may be formed in any convenient manner, such as, by casting or molding.

For the single deck pallet illustrated in FIGS. 1 to 3, the end cap 52 comprises a rectangular body which is dimensioned the same as the cross-section of the stringer elements 12 and has two pairs of L-shaped protrusions or flanges 54 and 56. The outer surfaces of the flanges 54 and 56 define the corners of a rectangle which is dimensioned slightly less than the dimension of the end opening to the stringer 12 to permit the flanges 54 and 56 to extend into the opening 57 in the end of the stringer element 12 in snug fit relationship with the interior walls 58 of the stringer element 12 so that the body abuts the perimeter of the end opening 57. The lower flanges 56 are formed larger than the upper ones 54 and may be provided with surface protrusions 60 to assist in frictional engagement with the inner walls 58 and inhibit ready removal therefrom.

An extension 62 is provided at the upper end of the end cap 52 to protrude above the upper surface 14 of the stringer element 12. The extension 62 includes a transverse slot 64 extending across the width of the end cap 52 and an inclined outer surface 66. The transverse slot 64 and the inclined outer surface 66 act as the undercut and shoulder respectively for the other end of the end pair of protrusions 20, as seen clearly in FIG. 3, the longer shoulder engaging member 36 extending into the transverse slot 64.

Figure 4:
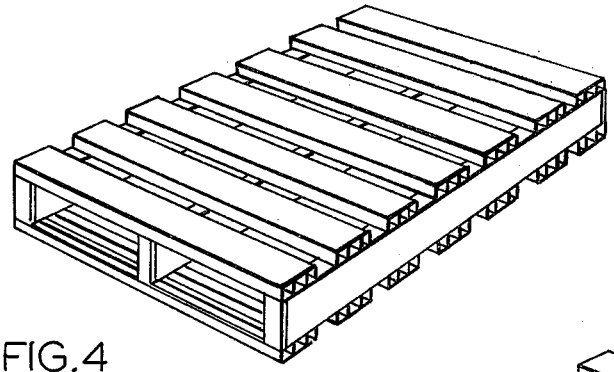
FIG. 4 is a perspective view of a double-deck two-way pallet provided in accordance with a second embodiment of this invention.
Figure 5:
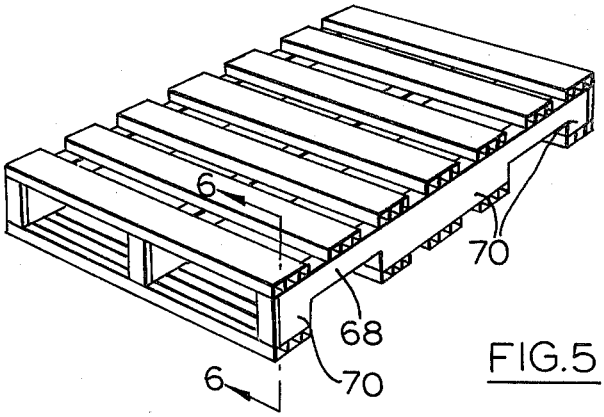
FIG. 5 is a perspective view of a double-deck four-way pallet provided in accordance with a third embodiment of this invention.

The principles of construction described above with respect to the embodiment of FIGS. 1 to 3, also apply with respect to the other pallet styles illustrated in FIGS. 4, 5 and 7. With respect to the latter, deck-forming members 16 are releasably connected to the underside of the stringer elements 12 in analogous manner with pairs of protrusions 20 providing the appropriate interlocking.

Figure 8:
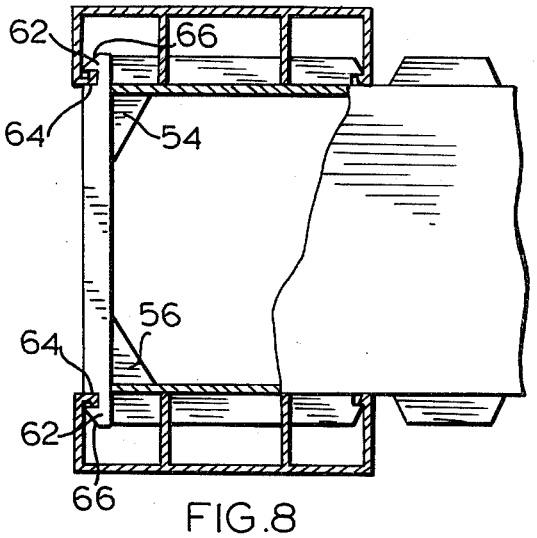
FIG. 8 is a close-up side elevational view, partly in section, of the pallet structure of FIG. 4.
Figure 6:
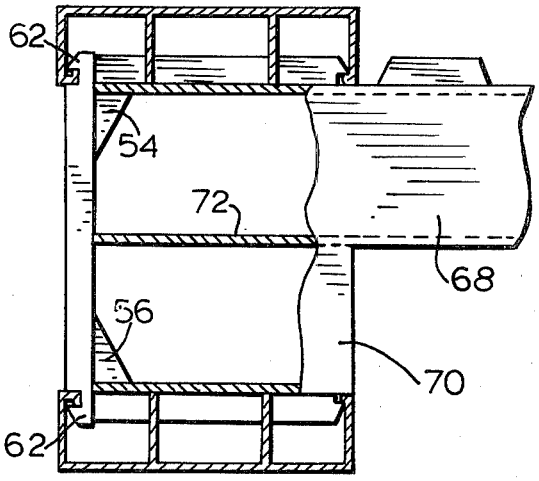
FIG. 6 is a sectional close up side elevational view partly in section, of part of the pallet of FIG. 5, illustrating the form of the stringer elements therein.

In addition for a double deck pallet, the end cap 52 is provided with extensions 62 at both the upper and lower ends thereof, each with an associated transverse slot 64 and inclined outer surface 66 (see FIG. 8). In this case, the flanges 54 and 56 are equally dimensioned.

The pallet 10 is assembled by, at each intersection of deck-forming member 16 and rectangularly cross-sectioned stringer 12, inserting the longer shoulder-engaging member 36 into the undercuts 26 of the pair of protrusions 20 or the transverse slot 64 in the case of the deck-forming member 16 at each end and pushing the shoulder shoulder-engaging member 38 against the upper and outer surface of the shoulders 28 or 48 of the pair of protrusions 20, causing the deck-forming member 16 to flex slightly about its centre line, thereby moving the shoulder-engaging members 36 and 38 a greater distance apart, so that the sloping surface 42 rides on and round the sloping surfaces 40 or 51 and snap fits into the undercuts 28 or 50 of the pair of protrusions 20 in engagement with the underside of the shoulders 24 or 48.

Disassembly of the interlock is readily achieved by flexing the deck-forming member 16 about its centre line until the shoulder-engaging members 36 and 38 are spaced apart a distance sufficient to remove the shoulder-engaging member 38 from the undercuts 28 and 50.

The positioning of an end cap 52 at each end of each stringer element 12 closes off the open ends of such elements present in the aforementioned structure of U.S. Pat. No. 3,971,326 and prevents the ingress of dirt, vermin or other unwanted items.

The end caps 52 are very rugged and provide part of the locking mechanism at the edges of the pallet. This structure is considerably stronger than the prior art one in that the end caps 52 increase the overall strength and rigidity of the stringers 12. The end caps 52 obviate the possibility of accidental damage to end clips upon striking of the end deck-forming member by tines, since such clips no longer are used and are replaced by the slots 64 in the end cap 52 of considerably increased dimension with respect to the prior art clip undercuts.

If the end deck-forming member 16 is accidentally damaged, then it is a simple matter to replace the damaged member, without having to replace the stringer elements 12. The end caps 52 thereby considerably improve the prior art pallet structure.

The skirt portion 32 of the deck-forming member 16 at the end of the pallet is thicker than the other skirt portion to provide added strength to the end deck-forming member and further inhibit damage to the pallet structure.

The pallet may be provided in a 4-way double-deck form, as shown in FIG. 5, and a similar 4-way single-deck form also may be provided. The stringer element 12 for such 4-way constructions are constructed differently from the stringer elements 12 of the 4-way constructions of the aforementioned prior art U.S. Pat. Nos. 3,971,326 and 4,077,334, and is integrally-formed, as compared with the multi-component form used in the prior art.

The stringer element 12 used in the 4-way construction has an upper enclosed continuous rectangular portion 68 and lower enclosed longitudinally-spaced rectangular portions 70 which are integral with the continuous rectangular portion 68 and share a common wall 72.

It will be seen from this description that the present invention provides a pallet construction which has a knock-down form and which is formed from only two types of members, the members of each type being completely interchangeable one with another.

The knock-down form of the pallet permits shipping and storage in compact form with consequently decreased shipping, storage and inventory costs as compared with conventional wooden pallets. The use of aluminum as the preferred material of construction results in a pallet which is not damaged by the elements and fire, which is 100% recyclable, and which is lighter in weight, imparting additional benefits as compared with conventional wooden pallets.

What I claim is:

1. A pallet construction, comprising at least two spaced-apart substantially parallel longitudinally-extending hollow members, each of said hollow members having a cap closing off each end thereof, a first plurality of deck-forming members contacting and extending at least between the at least two longitudinally-extending members generally transverse thereto in spaced-apart relation, each of said first plurality of deck-forming members having at least one planar portion cooperating with the at least one planar portion of the others of said first plurality of deck-forming members to provide a first planar pallet deck surface which extends substantially the length of said longitudinally-extending members, snap fit means releasably interconnecting said at least two longitudinally-extending members with each of said first plurality of deck-forming members at the intersections thereof, at each said intersection, said snap fit means includes a first part integral with said longitudinally-extending member and a second cooperating part integral with said deck-forming member, said first part integral with said longitudinally-extending member at each longitudinal extremity of said longitudinally-extending member including a portion of said end cap, and stop means located at each intersection and preventing movement of each of said first plurality of deck-forming members longitudinally thereof and transverse to said at least two longitudinally-extending members while normally permitting movement of said first plurality of deck-forming members out of contact with said longitudinally-extending members upon release of said snap fit means to allow disassembly of said pallet, said stop means at each said intersection including cooperating elements integral with said longitudinally-extending member and integral with said deck-forming member.

2. The pallet construction of claim 1 including:

a second plurality of deck-forming members contacting and extending at least between the at least two longitudinally-extending members generally transverse thereto and on the opposite side thereof from said first plurality of deck-forming members, each of said second plurality of deck-forming members being constructed identically with said first plurality of deck-forming members to provide a second planar deck surface which extends substantially the length of said longitudinally-extending members parallel to said first planar pallet deck surface to provide a double-deck pallet, second snap fit means constructed identically with said first snap fit means and releasably interconnecting said at least two longiudinally-extending members with each of said second plurality of deck-forming members at the intersections thereof, and second stop means located at each said latter intersection and preventing movement of each of said second plurality of deck-forming members longitudinally thereof and transverse to said at least two longitudinally-extending members while normally permitting movement of said second plurality of deck-forming members out of contact with said longitudinally-extending members upon release of said second snap fit means to allow disassembly of said pallet, said second stop means being constructed in identical manner to said stop means at each said former intersection.

3. The pallet construction of claim 1 including three of said longitudinally-extending members constructed identically and substantially equally spaced from each other, and wherein each of said first plurality of deck-forming members is constructed identically and extends between the outer ones of said three longitudinally-extending members and terminates either flush with the outer edge of said outer ones or overhanging said outer edges, each of said spaced-apart longitudinally-extending members including a supporting surface receiving said first plurality of deck-forming members thereon.

4. The pallet construction of claim 2 including three of said longitudinally-extending members constructed identically and substantially equally spaced from each other, and wherein each of said first and second plurality of deck-forming members is constructed identically and extends between the outer ones of said three longitudinally-extending members and terminates either flush with the outer edge of said outer ones or overhanging said outer edges, each of spaced-apart longitudinally extending members including supporting surfaces receiving said first and second plurality of deck-forming members thereon.

5. The pallet construction of claim 1 wherein each of said longitudinally extending members has a generally rectangular cross section throughout the length thereof, one of the shorter dimension sides of said rectangular cross section receiving said first plurality of deck-forming members thereon, and said end cap includes a generally flat rectangular body portion dimensioned substantially the same as the cross sectional dimension of said longtudinally-extending member, means mounting said end cap in press-fit relationship with the end opening and protrusion means from one shorter dimension side of said body portion constituting said portion of said end cap included in said snap fit means.

6. The pallet construction of claim 2 wherein each of said longitudinally-extending members has a generally rectangular cross section throughout the length thereof, the shorter dimension sides of said rectangular cross section receiving said first and second plurality of deck-forming members thereon, and said end cap includes a generally flat rectangular body portion dimensioned substantially the same as the cross-sectional dimension of said longitudinally-extending member, means mounting said end cap in press-fit relationship with said end opening and protrusion means from each shorter dimension side of said body portion constituting said portions of said end cap included in said former and second snap fit means.

7. The pallet construction of claim 5 wherein said mounting means comprise four L-shaped cross section bracket means integral with said body portion and extending into the end opening of said longitudinally-extending member in press-fit engagement with the respective corners of the inner walls thereof.

8. The pallet construction of claim 6 wherein said mounting means comprise four L-shaped cross section bracket means integral with said body portion and extending into the end opening of said longitudinally-extending member in press-fit engagement with the respective corners of the inner walls thereof.

9. The pallet construction of claim 7, wherein each of first plurality of deck-forming members includes at least one planar portion spaced from said supporting surface at said intersections, first and second wall portions depending from said at least one planar portion and having inwardly-directed protrusions constituting said second cooperating part of said snap fit means, each of said longitudinally-extending members includes at each longitudinal end thereof at least one elongate protrusion from said supporting surface having a shoulder projecting from the end thereof remote from the member end to define an undercut with the supporting surface and, between said at least one elongate protrusion at the longitudinal ends, at least one additional elongate protrusion at each said intersection having a shoulder at each end to define an undercut at each end with the supporting surface, said protrusions constituting said first part of said snap fit means, and said end cap protrusion defining a channel extending transversely across the width thereof and constructed to receive one of said inwardly-directed protrusions.

10. The pallet construction of claim 9, wherein one of said inwardly-directed protrusions extends inwardly a distance greater than that of the other of said inwardly-directed protrusion and the wall portion bearing said longer inwardly-directed protrusion is thicker than the wall portion bearing said shorter inwardly-directed protrusion.

11. The pallet construction of claim 9 wherein said stop means at each intersection is constituted by interference between said at least one elongate protrusion and slots formed in said deck-forming member.

12. The pallet construction of claim 8, wherein each of said first and second plurality of deck-forming members includes at least one planar portion spaced from the respective supporting surfaces at said intersections, first and second wall portions depending from said at least one planar portion and having inwardly-directed protrusions constituting said second cooperating part of said snap fit means, each of said longitudinally-extending members includes at each longitudinal end thereof at least one elongate protrusion from said supporting surface having a shoulder projecting from the end thereof remote from the member end to define an undercut with the supporting surface and, between said at least one elongate protrusion at the longitudinal ends, at least one additional elongate protrusion at each said intersection having a shoulder at each end to define an undercut at each end with the supporting surface, said protrusions constituting said first part of said snap fit means, and said end cap protrusions each defining a channel extending transversely across the width thereof and constructed to receive one of said inwardly-directed protrusions.

13. The pallet construction of claim 12, wherein one of said inwardly-directed protrusions extends inwardly a distance greater than that of the other of said inwardly-directed protrusion and the wall portion bearing said longer inwardly-directed protrusion is thicker than the wall portion bearing said shorter inwardly-directed protrusion.

14. The pallet construction of claim 12, wherein said stop means at each intersection is constituted by interference between said at least one elongate protrusion and slots formed in said deck-forming member.

15. The pallet construction of claim 1 wherein each of said longitudinally-extending members comprises a continuous square or rectangularly cross-sectioned portion extending the length thereof and three longitudinally spaced-apart square or rectangularly cross-sectioned portions integrally formed with said continuous portion and sharing a common wall therewith, one of said spaced-apart members being located at each end of said longitudinally-extending member and one being located approximately equidistantly spaced from said end-located members.

16. The pallet construction of claim 2 wherein each of said longitudinally-extending members comprises a continuous square or rectangularly cross-sectioned portion extending the length thereof and three longitudinally spaced-apart rectangularly cross-sectioned portions integrally formed with said continuous portion and sharing a common wall therewith, one of said spaced-apart members being located at each end of said longitudinally-extending member and one being located approximately equidistantly spaced from said end-located members.

17. The pallet construction of claim 15 wherein said end cap includes a generally flat rectangular body portion dimensioned substantially the same as the total cross-sectional dimension of the end of said longitudinally-extending member, means mounting said end cap in press-fit relationship with the end opening and protrusion means from one shorter dimension side of said body portion constituting said portion of said end cap included in said snap fit means.

18. The pallet construction of claim 17 wherein said mounting means comprise four L-shaped cross-section bracket means integral with said body portion and extending into the end opening of said longitudinally-extending member in press-fit engagement with the respective corners of the inner walls thereof.

19. The pallet construction of claim 16 wherein said end cap includes a generally flat rectangular body portion dimensioned substantially the same as the total cross sectional dimension of the end of said longitudinally-extending member, means mounting said end cap in press-fit relationship with the end opening and protrusion means from each shorter dimension side of said body portion constituting said portions of said end cap included in said former and second snap fit means.

20. The pallet construction of claim 19 wherein said mounting means comprise four L-shaped cross-section bracket means integral with said body portion and extending into the end opening of said longitudinally-extending member in press-fit engagement with the respective corners of the inner walls thereof.

21. The pallet construction of claim 1 wherein said members are formed by extrusion from aluminum and said end caps each are formed by casting of aluminum.

* * * * *